United States Patent [19]

Ohiwa et al.

[11] Patent Number: 4,947,081

[45] Date of Patent: Aug. 7, 1990

[54] DUAL INSULATION OXYNITRIDE BLOCKING THIN FILM ELECTROLUMINESCENCE DISPLAY DEVICE

[75] Inventors: Tsunemi Ohiwa, Osaka; Keiichiro Uenae, Kyoto; Souichi Ogawa, Kobe; Katsumi Takiguchi, Ikeda; Masaaki Yoshitake, Uji, all of Japan

[73] Assignee: Hitachi Maxell, Ltd., Osaka, Japan

[21] Appl. No.: 318,052

[22] Filed: Feb. 24, 1989

[30] Foreign Application Priority Data

Feb. 26, 1988 [JP] Japan ..... 63-44959

[51] Int. Cl.[5] ..... H05B 33/22

[52] U.S. Cl. ..... 313/509; 313/506; 428/662; 428/689; 428/917

[58] Field of Search ..... 313/506, 509; 252/62.32 B; 428/662, 689, 917

[56] References Cited

U.S. PATENT DOCUMENTS 4,672,266 6/1987 Taniguchi et al. ..... 313/509

4,721,631 1/1988 Endo et al. ..... 313/509 X

*Primary Examiner*—Kenneth Wieder

*Attorney, Agent, or Firm*—Birch, Stewart, Kolasch & Birch

[57] ABSTRACT

In a dual insulation thin film type electroluminescence device comprising a first insulation layer, a light emitting layer and a second insulation layer between a transparent electrode layer and a back electrode layer, a tantalum oxynitride layer is provided between the transparent electrode layer and the first insulation layer to prevent increase of the resistance in the transparent electrode and to prevent increase of current leakage in the insulation layer so that a high luminescence can be achieved.

4 Claims, 2 Drawing Sheets

DUAL INSULATION OXYNITRIDE BLOCKING THIN FILM ELECTROLUMINESCENCE DISPLAY DEVICE

BACKGROUND OF THE INVENTION

1. FIELD OF THE INVENTION

The present invention relates to a thin film electroluminescence device having dual insulation layers, and more particularly to an improvement of a structure at the interface between a transparent electrode and first insulation layer.

2. DESCRIPTION OF THE PRIOR ART

A conventional thin film electroluminescence device having dual insulation layers is so arranged that a transparent electrode 22 is deposited on a transparent base plate 21 and a first insulating layer 23 is deposited on the transparent electrode 22. On the first insulating layer 23 a light emitting layer 24, a second insulating layer 25 and a back electrode 26 are laminated, as shown in FIG. 1, and a power supply 27 is connected across the back electrode 26 and the transparent electrode 22. As the material of the first insulating layer 23, there has been used $Ta_2O_5$ (tantalum oxide) as disclosed in the Japanese Patent publication (unexamined) Tokkai sho-58-157887 since $Ta_2O_5$ has a high dielectric constant and is stable under a high electric field, therefore $Ta_2O_5$ shows excellent properties as the insulating material.

However, in the case when a $Ta_2O_5$ layer is deposited as the first insulating layer 23 on the transparent electrode 22, the resistance of the ITO (indium tin oxide),of the transparent electrode 22 increases and it becomes difficult to provide bright electroluminescence elements. It is noted that oxygen diffuses into the $Ta_2O_5$ layer at the time of forming the ITO layer, such that the diffusion of the oxygen causes an increase in the resistance of the transparent electrode 22.

It is known that the increase in the resistance of the ITO layer can be prevented if the, $Ta_2O_5$ layer is deposited after a $SO_2$ layer is deposited according to the existing literature, for example by Y. Simizu, and T. Matsudaira, IEEE 1985, Inter. Display Research Conf. P101. However, to employ the above technique may invite the problems whereby a high drive voltage is required because the dielectric constant of the material used therein is too low.

The present inventors have tried to form the $Ta_2O_5$ layer under a low temperature. In this technique, although the increase in the resistance of the ITO layer can be suppressed, there tends to result in an oxygen deficiency in the $Ta_2O_5$ layer, whereby it is difficult to form a $Ta_2O_5$ layer in which current leakage is small.

SUMMARY OF THE INVENTION

An essential object of the present invention is to provide a thin film electroluminescence device of the dual insulation layer type, having a first insulation layer made of a $Ta_2O_5$ layer, which is capable of emitting bright light by eliminating such problems whereby the resistance of the transparent electrode increases when the $Ta_2O_5$ layer is deposited and the current leakage which flows through the $Ta_2O_5$ layer is large.

According to the present invention, a tantalum oxynitride layer is provided between the first insulation layer and the transparent electrode, whereby an increase of the resistance value of the transparent electrode can be prevented and the current leakage which flows through the $Ta_2O_5$ layer can be decreased.

According to the present invention, when the tantalum oxynitride ($Ta_2O_xN_y$) layer is formed on the ITO layer of the transparent electrode layer and the first insulation layer of the $Ta_2O_5$ is formed on the tantalum oxynitride layer, the tantalum oxynitride layer acts as an oxygen passivation layer so that the diffusion of oxygen from the $Ta_2O_5$ above the ITO layer during the film forming can be prevented and accordingly an increase in the resistance of the ITO layer can be prevented. According to the present invention, the oxygen deficiency in the ITO layer provides the desired low resistivity. On the other hand for the $Ta_2O_5$ layer, if sufficient oxygen is not supplied, there occurs an oxygen deficiency and it is difficult to form the transparent $Ta_2O_5$ layer. Therefore, oxygen is forcibly supplied and a part of the oxygen would normally diffuse into the ITO layer so that the resistance of the ITO layer would increase. However, provision of the tantalum oxynitride layer on the ITO layer prevents the diffusion of the oxygen into the ITO layer.

In preparing the tantalum oxynitride layer ($Ta_2O_xN_y$ layer), oxygen and nitrogen are supplied, nitrogen can be doped, and the oxygen defects do not occur to the ITO layer. Because forcible oxygen supply is not needed, the diffusion of oxygen to the ITO layer can be prevented, whereby the resistance of the ITO layer does not increase.

The tantalum oxynitride ($Ta_2O_xN_y$) becomes a transparent, high resistance semiconductor by controlling the proper amount of nitrogen and oxygen.

When an electric field is applied to the dielectric material such as $Ta_2O_5$, only a small amount of current will leak if the electric field is low; however, if the electric field is high enough so as to emit the eletroluminescence light, a large amount of current will flow through the $Ta_2O_5$ layer by the Pool-Frankel model conduction. If the tantalum oxynitride layer is provided between the ITO layer and $Ta_2O_5$ layer, since the tantalum oxynitride layer is an insulator and the oxygen defect has been eliminated, the undesired current leakage is suppressed and a high electric field can be easily applied to the light emitting layer.

The tantalum oxynitride is expressed by the chemical equation $Ta_2O_xN_y$ and the value x is preferably in the range between 2.5 to 4.9 the tantalum oxynitride is transparent and functions as a high resistance semiconductor. If the value x is smaller than 2.5, the tantalum oxynitride is colored. If the value x is greater than 4.9, the tantalum oxynitride becomes dielectric material and does not contribute to suppressing current leakage. The value y is preferably in the range between 0.007 to 1.6. The value y is controlled by the value x.

Namely, in $Ta_2O_xN_y$, the stoichiometric ratio of the total amount of oxygen and nitrogen to Ta is the same as that of oxygen to tantalum in $Ta_2O_5$.

DETAILED DESCRIPTION OF THE PREFERRED EMBODIMENTS

Figure 2:
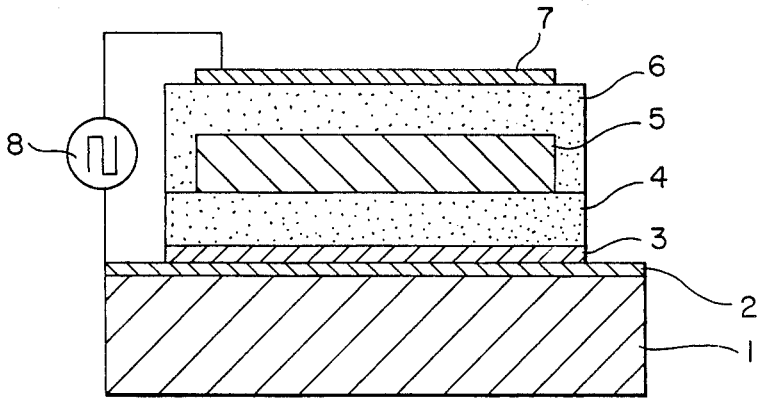
FIG. 2 is a cross sectional view showing an example of the electroluminescence device according to the present invention.

Referring to FIG. 2 showing an embodiment of the electroluminescence device according to the present invention, reference numeral 1 is a transparent base plate made of, for example, a transparent glass plate. A transparent electrode 2 is made of a ITO layer deposited of the base plate 1. The thickness of the ITO layer 2 is about 2,000 Å with the electrical resistance of 10 Ω. A Tantalum oxynitride ($Ta_2O_xN_y$) layer 3 is deposited on the surface of the transparent electrode layer 2 by sputtering method or CVD method (chemical vapor deposition) with a thickness range of from 20 to 2,000 Å. A first insulation layer 4 made of $Ta_2O_5$, $SiO_2$, $Al_2O$ or $Si_3N_4$ is deposited on layer 3 and a light emitting layer 5 of from 5,000 to 10,000 Å thick is deposited on the first insulation layer 4. As the light emitting material, there may be used ZnS:Mn, ZnS:Tb, F, and CaS:Eu. A second insulation layer 6 is deposited on the light emitting layer 5 and is made of $Ta_2O_5$, $SiO_2$, $Al_2O_3$, and $Si_3N_4$. A back electrode 7 is deposited on the second insulation layer 6 made of aluminum or the like. The respective layers of the first insulation layer 4, light emitting layer 5, second insulation layer 6 and back electrode layer 7 may be deposited by conventional CVD method, vacuum deposition method, or sputtering method. A power source 8 is connected to the transparent electrode 2 and the back electrode 7 so that the electroluminescence device is driven.

In the embodiment of the electroluminescence device as shown in FIG. 2, since the tantalum oxynitride layer 3 is deposited on the transparent electrode layer 2 made of ITO, the diffusion of oxygen to the transparent electrode layer 2 can be prevented even if $Ta_2O_5$ is used as the first insulation layer 4, so that an increase of the resistance of the transparent electrode layer 2 can be prevented.

When tantalum oxynitride layer 3 is deposited between the transparent electrode layer 2 and the first insulation layer 4, the interface condition between the layers 2 and 4 can be much improved so that the current leakage in the first insulation layer can be decreased when the voltage is applied.

As mentioned above, the thickness of the tantalum oxynitride layer 3 is preferably from 20 to 2,000 Å, because if the thickness is smaller than 20 Å, the effect of preventing the diffusion of oxygen to the transparent electrode layer at the time of the formation of the $Ta_2O_5$ layer is degraded and the effect of decreasing the current leakage is degraded. If the thickness of the tantalum oxynitride is more than 2,000 Å, the layer is colored and it becomes difficult to see the light emission of the light emitting layer 5.

Figure 3:
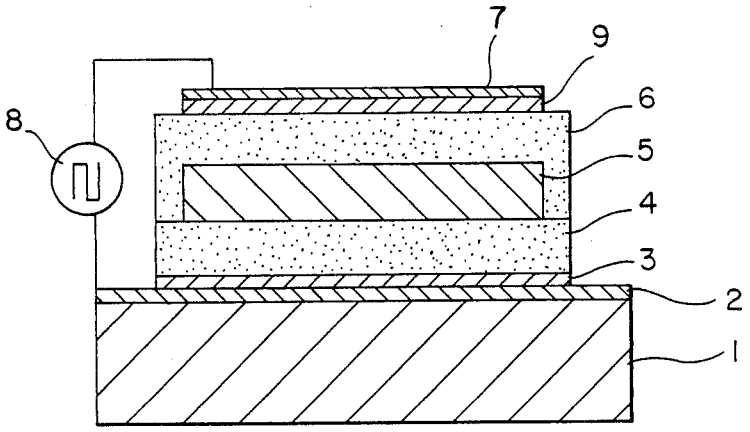
FIG. 3 is a cross sectional view showing another example of the electroluminescence device according to the present invention.

FIG. 3 is another embodiment of the electroluminescence device according to the present invention, wherein there is further provided another tantalum oxynitride layer 9 between the second insulation layer 6 and the back electrode layer 7. The remaining structure is the same as shown in FIG. 2. As shown in the embodiment of FIG. 3, by providing the tantalum oxynitride layer 9 between the second insulation layer 6 and back electrode 7, the interface condition of the second insulation layer 6 and the back electrode layer 7 can be improved so that current leakage can be decreased.

PREFERRED EMBODIMENTS

Examples

Example 1

A transparent non alkaline glass plate (manufactured by Coaning corporation in U. S. A. serial number 7059) was used as the transparent base plate and the ITO layer was deposited on the glass plate with 2,000 Å thick by the vacuum deposition method and the ITO layer was etched by a given pattern to provide the transparent electrode. Next, using a radio frequency sputtering system, the tantalum oxynitride layer ($Ta_2O_xN_y$ layer) was sputtered from $Ta_2O_5$ target in the mixture of Ar, $O_2$ and $N_2$. During the deposition of this layer Ar pressure was kept constant while $O_2$ and $N_2$ pressures were changed and the sputtering time was controlled so as to reach 500 Å in thickness. Subsequently, in the same chamber, the $Ta_2O_5$ layer was deposited on the tantalum oxynitride layer ($Ta_2O_xN_y$ layer) with 3,000 Å thick by the sputtering under Ar-$O_2$ gas atmosphere, so that the first insulation layer was deposited. During the process of depositing the tantalum oxynitride layer and the first insulation layer, the transparent base plate was kept at the room temperature. Subsequently a ZnS : Tb, F phosphor layer with a 5,000 Å thickness was deposited on the first insulation layer by sputtering of ZnS : Tb, F and was annealed in vacuum at 450 C. for 2 hours, after deposition. Subsequently the second insulation layer with a 2,000 Å thickness was deposited on the light emitting layer by sputtering $Al_2O_3$, thereafter the back electrode layer of Aluminum with a 2,000 Å thickness was deposited on the second insulation layer using a mechanical mask.

Four examples 1-1 to 1-4 of the electroluminescence device were prepared in the same manner as mentioned above with the gas pressure ratio of the Ar, $O_2$ and $N_2$, the values x and y of the tantalum oxynitride layer ($Ta_2O_xN_y$) and thickness of the tantalum oxynitride layer as shown in the TABLE 1.

Example 2

Four examples 2-1 to 2-4 of the electroluminescence device were prepared in the same manner as mentioned in example 1 except that during the preparation of tantalum oxynitride the gas ratio of Ar, $O_2$ and $N_2$ was fixed as 5:1:4 and its thickness was changed as shown in TABLE 1.

TABLE 1

| | gas pressure (torr) | | | values x and y of $Ta_2OxNy$ layer | | thickness of tantalum oxynitride layer (Å) | threshold voltage (V) | luminance (cd/M) |
|---|---|---|---|---|---|---|---|---|
| | Ar | $O_2$ | $N_2$ | x | y | | | |
| EX 1-1 | 0.030 | 0.010 | 0.010 | 4.9 | 0.07 | 500 | 265 | 1250 |
| EX 1-2 | 0.030 | 0.005 | 0.015 | 4.0 | 0.67 | 500 | 260 | 1480 |
| EX 1-3 | 0.025 | 0.005 | 0.020 | 3.0 | 1.34 | 500 | 260 | 1530 |
| EX 1-4 | 0.020 | 0.002 | 0.025 | 2.5 | 1.60 | 500 | 260 | 1490 |
| EX 2-1 | 0.025 | 0.005 | 0.020 | 3.0 | 1.37 | 20 | 270 | 1080 |
| EX 2-2 | 0.025 | 0.005 | 0.020 | 3.0 | 1.37 | 200 | 265 | 1360 |
| EX 2-3 | 0.025 | 0.005 | 0.020 | 3.0 | 1.37 | 1,000 | 260 | 1490 |

TABLE 1-continued

| | gas pressure (torr) | | | values x and y of $Ta_2OxNy$ layer | | thickness of tantalum oxynitride layer (Å) | threshold voltage (V) | luminance (cd/M) |
|---|---|---|---|---|---|---|---|---|
| | Ar | $O_2$ | $N_2$ | x | y | | | |
| EX 2-4 | 0.025 | 0.005 | 0.020 | 3.0 | 1.37 | 2,000 | 250 | 1220 |
| comparative example | — | — | — | — | — | — | 270 | 730 |

COMPARATIVE EXAMPLE 1

Figure 1:
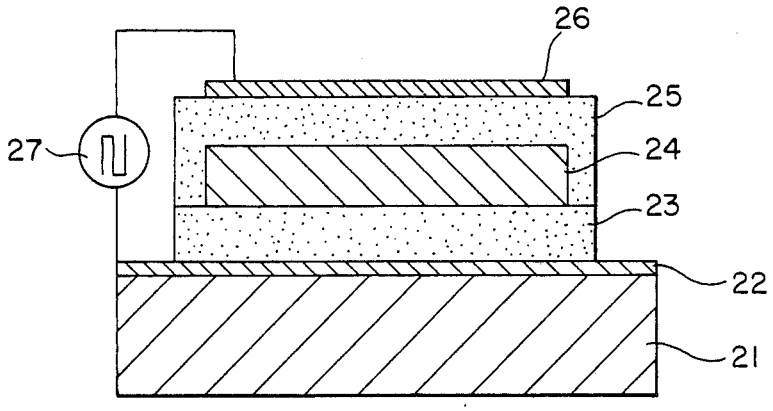
FIG. 1 (Prior Art)
FIG. 1 is a cross sectional view showing an example of a conventional electroluminescence device.

A comparative example of the electroluminescence device was prepared in the same manner as mentioned in example 1 except that the tantalum oxynitride layer was not deposited. The comparative example 1 is the conventional electroluminescence device as shown in FIG. 1, wherein the first insulation layer 23 made of $Ta_2O_5$ film is deposited directly on the transparent electrode 22.

A pulse wave of 5 KHz with 50% duty cycle was supplied to the respective examples 1 and 2 and the comparative example 1 of the electroluminescence devices is shown in TABLE 1. When the threshold voltage of plus 60 volts was applied, the threshold voltage and the luminance by the respective examples were measured. The result of the measurements are shown in the TABLE 1.

As understood from the comparison in TABLE 1, the luminance (when the threshold voltage of plus 60 volts is applied) the electroluminescence device of the examples 1 and 2 is much increased by depositing the tantalum oxynitride layer ($Ta_2O_xN_y$ layer) between the first insulation layer and the transparent electrode layer and the threshold voltage is slightly lowered. The maximum voltage which can be applied to the device is also increased.

It can be assumed that the reason why the luminance increases by the provision of the tantalum oxynitride layer between the first insulation layer and the transparent electrode layer is that increase in the resistance of the ITO film is prevented and the current leakage decreases by the provision of the tantalum oxynitride layer.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A dual insulation thin film electroluminescence device comprising a transparent electrode layer, a first insulation layer, a light emitting layer superimposed on said first insulation layer, a second insulation layer superimposed on said light emitting layer, and a back electrode layer, said electroluminescence device further comprising a tantalum oxynitride layer between said transparent electrode layer and said first insulation layer.

2. The thin film electroluminescence device according to claim 1, wherein said tantalum oxynitride layer is represented by the expression $Ta_2O_xN_y$ wherein x ranges from 2.4 to 4.9 and y ranges from 0.007 to 1.6.

3. The thin film electroluminescence device according to claim 1, said device further comprising a second tantalum oxynitride layer between said second insulation layer and said back electrode layer.

4. The thin film eletroluminescence device according to claim 3, wherein said second tantalum oxynitride layer is represented by the equation $Ta_2O_xN_y$, such that x ranges from 2.4 to 4.9 and y ranges from 0.007 to 1.6.

* * * * *

UNITED STATES PATENT AND TRADEMARK OFFICE

CERTIFICATE OF CORRECTION

PATENT NO. : 4,947,081

DATED : August 7, 1990

INVENTOR(S) : Tsunemi OHIWA et al

It is certified that error appears in the above-identified patent and that said Letters Patent is hereby corrected as shown below:

Title Page:

Item 73, Assignee, should be Hitachi Maxell, Ltd., and Osaka Prefecture, Osaka, Japan

Signed and Sealed this

Seventh Day of January, 1992

*Attest:*

HARRY F. MANBECK, JR.

*Attesting Officer*

*Commissioner of Patents and Trademarks*